US005417039A

United States Patent [19]

Hansson et al.

[11] Patent Number: 5,417,039

[45] Date of Patent: May 23, 1995

[54] METHOD AND AN APPARATUS FOR FILLING PACKAGING, IN PARTICULAR PAPER SACKS OR PAPER BAGS

[75] Inventors: Per-Ulf Hansson, Achern; Gustav Kuckhermann, Lengerich, both of Germany

[73] Assignee: Icoma Packtechnik GmbH, Achern, Germany

[21] Appl. No.: 52,924

[22] Filed: Apr. 27, 1993

[30] Foreign Application Priority Data

Apr. 27, 1992 [DE] Germany ..... 42 13 772.1

[51] Int. Cl.[6] ..... B65B 11/58

[52] U.S. Cl. ..... 53/449; 53/468; 53/469; 53/574

[58] Field of Search ..... 53/449, 467, 468, 469, 53/567, 574

[56] References Cited

U.S. PATENT DOCUMENTS

| | | | |
|---|---|---|---|
| 2,027,342 | 1/1936 | Hopkins | 53/449 |
| 2,387,812 | 10/1945 | Sonneborn et al. | 53/468 |
| 3,306,001 | 2/1967 | Peppler | 53/449 |
| 3,531,908 | 10/1970 | Rausing et al. | 53/469 |
| 4,035,982 | 7/1977 | Paules | 53/449 |
| 4,341,054 | 7/1982 | Curtheoux | 53/469 |
| 4,495,748 | 1/1985 | Rowell | 53/449 |
| 4,674,268 | 6/1987 | Gavronsky | 53/468 |
| 4,815,253 | 3/1989 | Kovacs et al. | 53/449 |
| 4,979,353 | 12/1990 | Seppala | 53/449 |
| 5,212,931 | 5/1993 | Hartmann | 53/449 |

*Primary Examiner*—W. Donald Bray
*Attorney, Agent, or Firm*—Pollock, Vande Sande & Priddy

[57] ABSTRACT

A method for filling packaging including an outer paper packaging member and an inner plastic film bag member with a filling material that is contained in a filling material container arranged above the packaging. The method includes, in the vicinity of the filling material container, forming the plastic film bag member from a tubular film by providing a welded seam along a lower edge. The bag is spread apart at an open upper edge. The plastic film bag member is separated from the tubular film. The plastic film bag member is inserted over the filling material container. The filling material container is lowered together with the plastic film bag member into the outer packaging member. The filling material container is emptied into the plastic film bag member. The material filling container is moved back to a starting position above the packaging.

17 Claims, 3 Drawing Sheets

METHOD AND AN APPARATUS FOR FILLING PACKAGING, IN PARTICULAR PAPER SACKS OR PAPER BAGS

FIELD OF THE INVENTION

The present invention relates to a procedure for filling packaging, in particular paper sacks or paper bags, with filling material that is contained in a filling material container which is arranged above the packaging, and lowered into the packaging and, in the lowered position, is emptied within the packaging and then, after being emptied, moves back to its starting position.

BACKGROUND OF THE INVENTION

The use of a procedure of this kind for filling packaging is already known; these packagings do not consist entirely of paper or cardboard, but incorporate an inner layer of plastic film. The inner layer or the inner bag of plastic film is usually fixed to the adjacent layer of paper or cardboard by means of adhesive. Fixing the plastic inner bag to the outer bag is inconvenient if this is done only at one end of the package in a small area. If this is done, fragments of plastic remain on the outer packaging portion that consists of paper or cardboard after the loose inside bag has been separated, and this renders recycling of those layers of the packaging that are made of paper or cardboard considerably more difficult.

SUMMARY OF THE INVENTION

Proceeding from this prior art, it is the task of-the present invention to provide procedure and an apparatus that permits the simple and rapid filling of packaging, in particular paper sacks or paper bags that incorporate at least one layer of plastic that is joined loosely and without adhesives to the paper layer.

The solution to the above discussed prior art problems is that, prior to lowering the container for the filling material into the packaging, a bag that is made for example of plastic film and is closed at the bottom and open at the top, is slipped over the filling material container and then lowered into the packaging, which is preformed at least at the upper edge, together with the filling material container, the filling material container then being emptied into the plastic-film bag. In addition, it has also been found to be useful that the plastic film bag is formed from a tubular film by providing a welded seam on the underside, is separated along the upper edge, and after being separated from the remaining film tube, is slipped over the filling material container, all of this being done adjacent to the filling machine.

In an apparatus that is used to carry out the procedure according to the present invention, it is expedient that a delivery apparatus be provided, this incorporating grippers that are formed to fit over the filling material container when such is not in the lowered position. In this regard, it is also expedient that suction apparatuses for opening the plastic film bag are provided on the side that is to be open.

In further embodiment of the present invention, prior to lowering of the filling material container being lowered into the packaging, a paper bag which is closed at the bottom and open at the top is slipped over the filling material container and, together with the filling material container, is lowered into the preformed packaging incorporating plastic-film bag that is located in the preforming apparatus, is emptied into the paper bag and then, the packaging incorporates a plastic-film bag that encloses the paper bag. In such a procedure, the bag made of plastic film is located outside, whereas the paper bag is provided inside.

The method according to the present invention permits the simple filling of packaging that consists of both paper or cardboard, and plastic film. It is not necessary to join the plastic-film bag and paper packgaging together. Consequently, after use, the paper packaging and bags of plastic film can be separated from each other easily and without any residual pieces after they have been used so that recycling of the different materials is very simple.

A preferred embodiment of the present invention will be described in greater detail below on the basis of the drawings appended hereto. These drawings show the following:

DETAILED DESCRIPTION OF THE FIGURES

Figure 1:
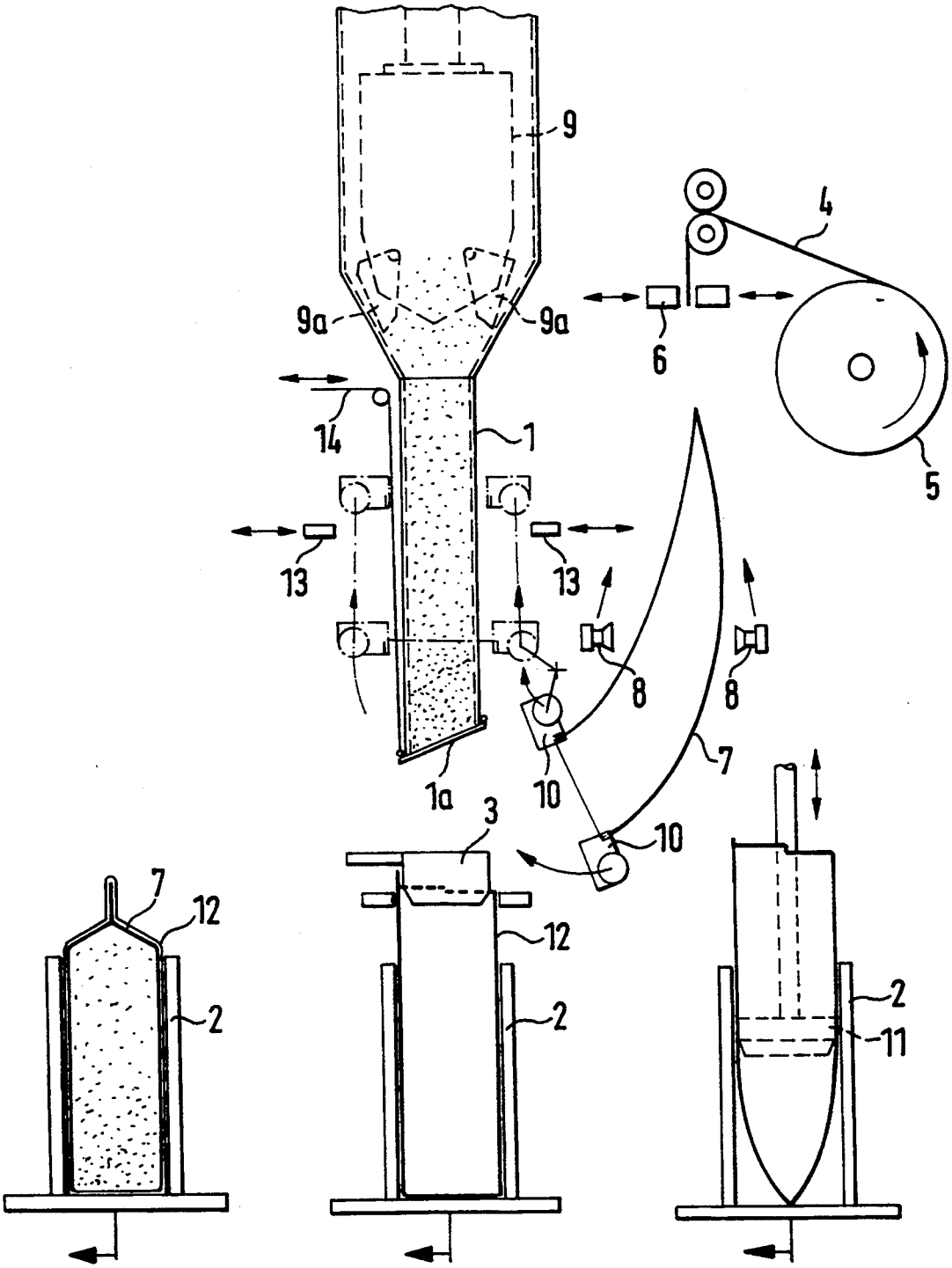
FIG. 1 is a diagrammatic representation of the apparatus according to the present invention prior to a bag of plastic foil being slipped over the filling-material container that is in its uppermost position.

The filling material is emptied from a supply container 9 by opening the base flaps 9*a* of the supply container 9, when it falls into a squared-off filling material container 1 within which, optionally, pre-compaction of the filling material can take place. At its lower end, the filling material container 1 has a flap la which can be opened and closed with the help of a traction cable 14.

Beneath the filling material container and aligned with it, there is located a preforming apparatus 2. The preforming apparatus 2 is used to preform the outer packaging 12, which can be, for example, a paper bag. The preforming is effected in that, within a station that precedes the filling station, and which is shown on the right in the drawing, the previously opened paper bag is formed with the help of a spreader 11 and then moved incrementally first into the filling station beneath the filling material container, and then into a closing station, each of these being shown on the left in the drawing.

Beneath the filling material container 1, the packaging or the paper bag that has been spread apart is held in its rectangular shape that is formed in the preforming apparatus. Opening paddles 3 press the narrow sides, within which there are side folds, so far apart that the filling material container can enter the bag so as to fill the package 12.

Figure 2:
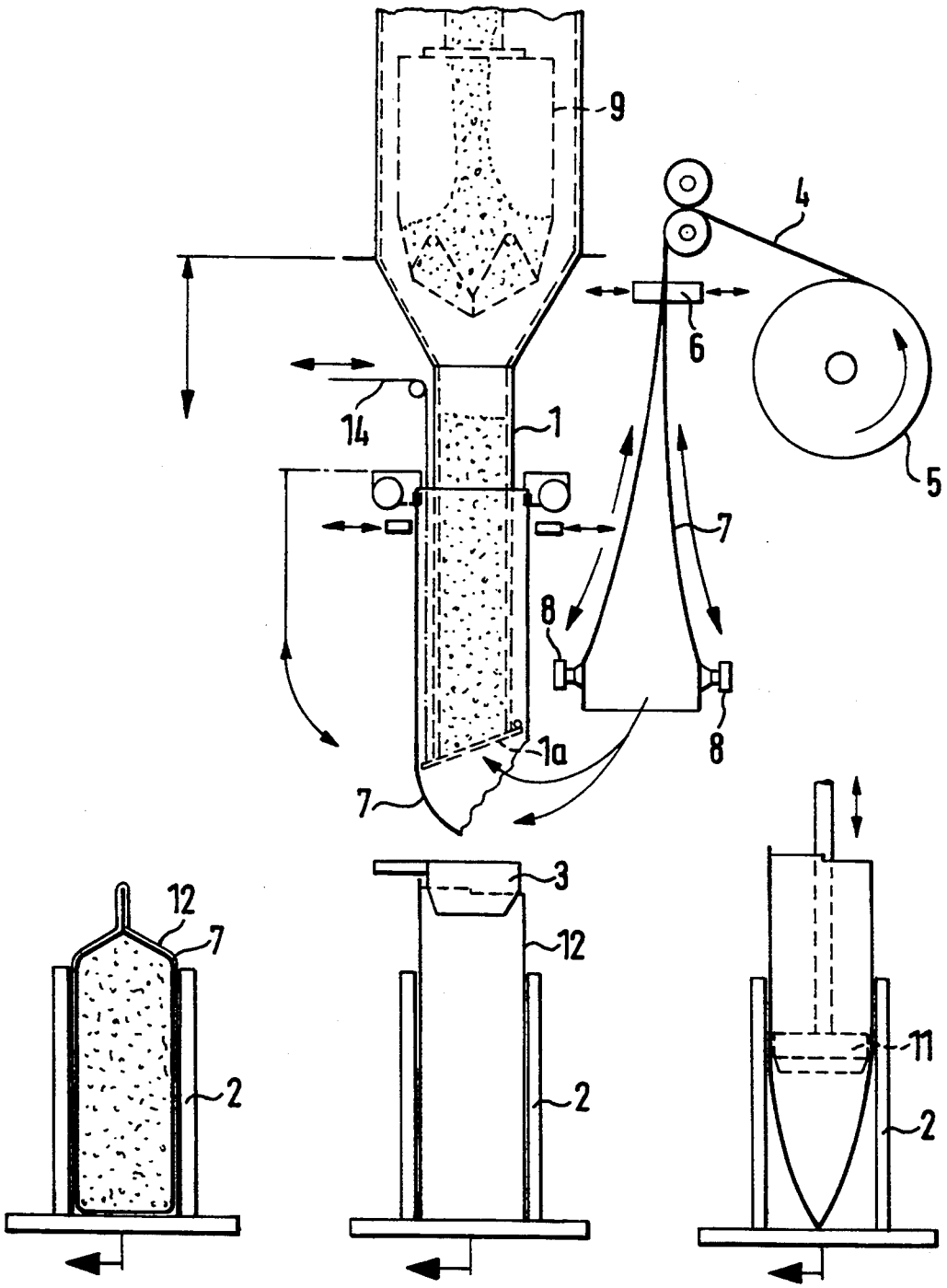
FIG. 2 is the filling-material container in an unchanged position, with the bag of plastic film slipped over it.
Figure 3:
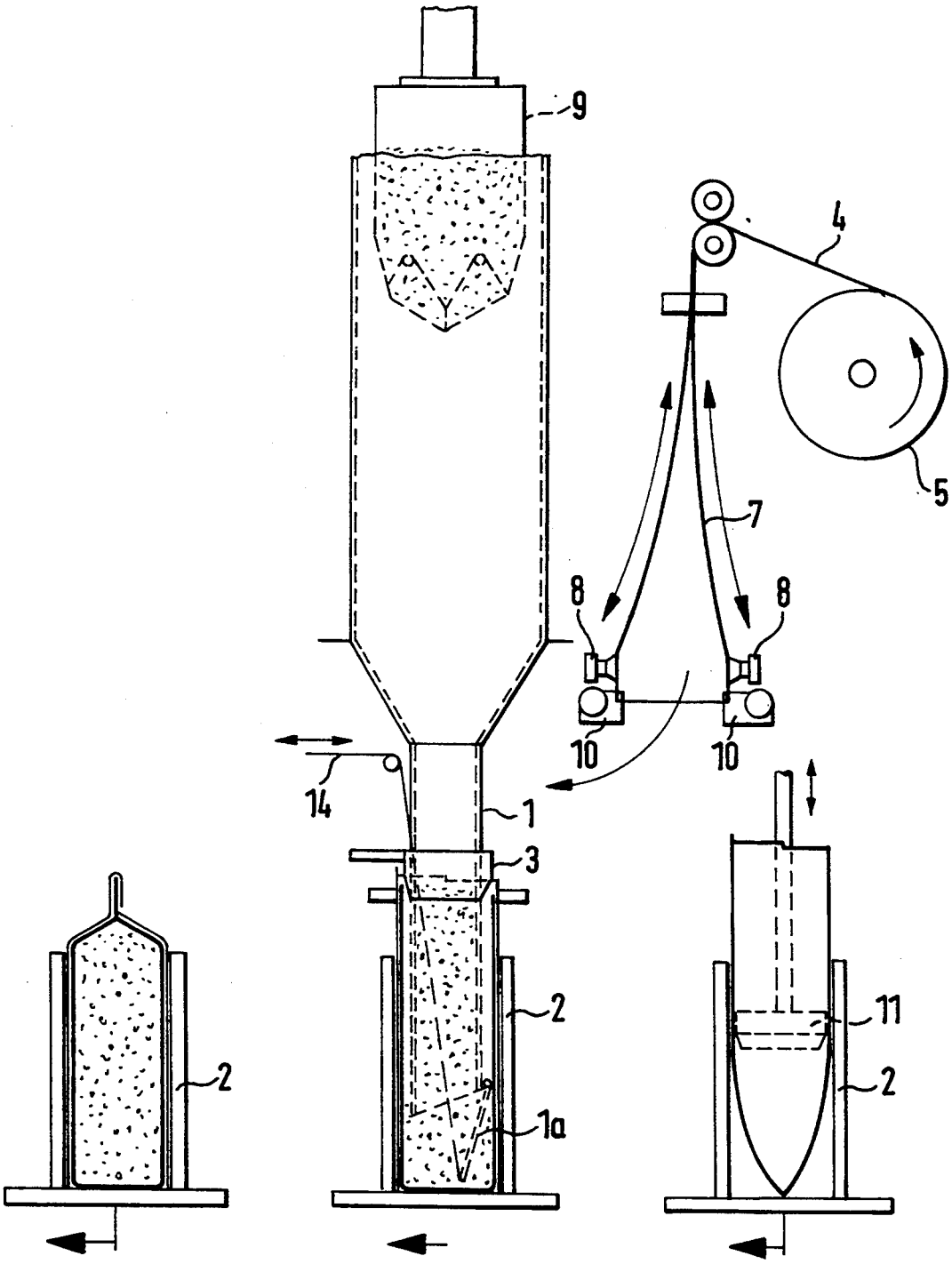
FIG. 3 is the filling-material container when lowered, when it is being emptied into the plastic-film bag and the outer packaging.

Adjacent to the filling material container there is a supply roll 5 of tubular film web 4. The tubular film is drawn off the supply roll 5, and the piece that is required to form a film bag is welded together at the end by means of the welding jaws 6. After the welding process, the plastic film bag 7 that has been formed in this way is perforated and separated from the remaining tubular film web 4. The plastic-film bag 7 is pre-opened with the help of suction devices 8. After the pre-opening procedure (see FIG. 2), the plastic film bag 7 that has been formed is gripped by the two open edges by two grippers 10 (see FIG. 1). The grippers 10 swing the plastic film bag 7 over the filling material container 1. The plastic film bag 7 is clamped onto the filling material container 1 by clamp rails 13. When in this clamped position, the plastic film bag 7, together with the filling material container 1, is lowered into the outer packaging 12 within the. preforming apparatus 2 (see FIG. 3). In the lowered position, the flap 1*a* of the filling material container is opened by means of the traction cable 14 so that the filling material can escape from the filling material container 1 into the plastic film bag 7. After the emptying process, the filling material container is moved upwards once again into the position shown in FIG. 1. The base flap 1*a* is closed, and a new cycle can begin.

We claim:

1. A method for filling packaging including an outer paper packaging member and an inner plastic film bag member with a filling material that is contained in a filling material container arranged above the packaging, said method comprising the steps of:

in the vicinity of said filling material container forming said plastic film bag member from a tubular film by providing a welded seam in said tubular film thereby forming a lower edge of said plastic film bag member;

opening said plastic film bag member at an open upper edge;

separating said plastic film bag member from said tubular film;

inserting said plastic film bag member over the filling material container;

lowering said filling material container together with said plastic film bag member into said outer packaging member;

emptying the filling material container into said plastic film bag member; and moving said material filling container back to a starting position above said packaging.

2. An apparatus for filling packaging including an outer paper bag or paper sack packaging member and an inner plastic film bag member with a filling material that is contained in a filling material container arranged above the packaging, said apparatus comprising:

means for forming a plastic film bag which is closed at the bottom and open at the top in the vicinity of the filing material container;

means for delivering and inserting said plastic film bag over the filling material container;

means for clamping said bag to said container such that said filling material container together with said plastic film bag is lowered into a preformed outer packaging member;

means for emptying the filling material container into said plastic film bag.

3. An apparatus according to claim 2 wherein said delivering and inserting means incorporate grippers that are formed to slip over the filling material container when said container is in said position above said packaging.

4. An apparatus according to claim 2, wherein said means for forming said bag include suction devices for opening the plastic film bags, provided on the side of the bag that is to be open.

5. An apparatus according to claim 2, wherein said means for forming a plastic bag comprises a roll of a tubular film web from which said plastic film bag member is formed.

6. An apparatus according to claim 2, wherein said means for forming a plastic bag comprises welding jaws for welding a seam in said tubular film web thereby creating a lower edge of said plastic film bag member and separating said plastic film bag member from said tubular film web.

7. An apparatus according to claim 2, wherein said filling material container includes at least one base flap for emptying said filling material container.

8. An apparatus according to claim 2, further comprising a preforming apparatus for receiving and preforming said outer packaging member.

9. An apparatus according to claim 8, wherein said preforming apparatus includes a spreader being inserted into said outer packaging member for preforming said outer packaging member.

10. An apparatus according to claim 8, wherein said preforming apparatus includes paddles for maintaining an open end of said outer packaging member open and pressing said open end of said outer packaging member against said preforming apparatus so as to help said filling material container to be inserted into said outer packaging member.

11. An apparatus according to claim 2, further comprising:

a preforming station where said outer packaging member is preformed;

a filling station where said inner bag member is inserted into said outer packaging member and said filling material container is emptied; and a closing station where said inner bag member and said outer packaging member are closed.

12. An apparatus according to claim 2, wherein said filling material container further comprises a supply container including at least one base flap.

13. A method according to claim 1, further comprising the step of preforming said outer packaging member by inserting said outer packaging member into a preforming apparatus and inserting a spreader into said outer packaging member prior to lowering said filling material container together with said inner bag member into said outer packaging member.

14. A method according to claim 1, further comprising the step of closing said inner bag member and said outer packaging member after emptying said filling material container into said inner bag member.

15. A method according to claim 1, further comprising the step of maintaining sides of said outer packaging member open thereby helping said filling material container and said outer bag member to be inserted into said outer packaging member.

16. A method for filling packaging including an outer packaging member and an inner packaging member, in particular paper sacks and paper bags, with a filling material that is contained in a filling material container arranged above the packaging, said method comprising the steps of:

providing a paper bag which is closed at the bottom and open at the top to constitute said inner packaging member;

inserting said paper bag over the filling material container;

lowering said filling material container together with said paper bag into an outer packaging member, preformed at least at its upper edge, and made of plastic;

emptying the filling material container into said paper bag; and moving said material filling container back to a starting position above said packaging; and wherein said packaging is formed with said plastic member substantially enclosing said paper bag.

17. A method according to claim 16, wherein the filling material container is lowered into the preformed packaging that is located in a performing apparatus.

* * * * *